US005622328A

United States Patent [19]

Norley

[11] Patent Number: 5,622,328

[45] Date of Patent: Apr. 22, 1997

[54] PAPER WINDER FOR WINDING A LENGTH OF WASTE PAPER FROM A PAPER CUP MAKING MACHINE

[76] Inventor: Michael Norley, 823 Lincoln Ave., West Chester, Pa. 19380

[21] Appl. No.: 495,220

[22] Filed: Jun. 27, 1995

Related U.S. Application Data

[63] Continuation of Ser. No. 122,916, Sep. 16, 1993, abandoned.

[51] Int. Cl.[6] ..... B65H 23/198

[52] U.S. Cl. ..... 242/413.5

[58] Field of Search ..... 242/413.5, 413.6, 242/413.4, 413.3, 413.7, 413.8, 420.6

[56] References Cited

U.S. PATENT DOCUMENTS

| | | | |
|---|---|---|---|
| 2,328,322 | 8/1943 | Berthold | 242/413.6 |
| 2,977,059 | 3/1961 | Mero | 242/413.6 |
| 3,762,662 | 10/1973 | Owens et al. | 242/413.7 |
| 3,785,588 | 1/1974 | Schramm | 242/413.6 |
| 4,216,804 | 8/1980 | Alexander et al. | 242/413.7 |
| 4,346,854 | 8/1982 | Markus et al. | 242/413.6 |
| 5,299,753 | 4/1994 | Alexander | 242/413.5 |

*Primary Examiner*—John M. Jillions

*Attorney, Agent, or Firm*—John F. A. Earley; John F. A. Earley, III

[57] ABSTRACT

A paper winder for winding a length of waste paper from a paper cup making machine for making cups for soft drinks.

2 Claims, 13 Drawing Sheets

REAR VIEW

PAPER WINDER FOR WINDING A LENGTH OF WASTE PAPER FROM A PAPER CUP MAKING MACHINE

This is a continuation of Ser. No. 122,916 filed on Sep. 16, 1983, now abandoned.

BACKGROUND OF THE INVENTION

1. Field of the Invention

The present invention relates to the field of collecting waste paper from a paper cup making machine used to make cups for soft drinks sold in fast food restaurants like McDonalds and Burger King, and more particularly concerns a paper winder for winding the length of waste paper from such cup making machines 2. Description of the Prior Art Wax-coated paper cups for soft drinks sold in fast food restaurants like McDonalds and Burger King are made using a cup making machine. During the manufacturing of such cups, a long strip of wax-coated paper is used to form the bottoms of the cups by punching out circular inserts from the strip of wax-coated paper. After the strip of paper has been punched by the cup making machine, the remainder of the strip is considered to be waste paper and must be disposed of.

Vacuum systems may be used to handle the waste paper, but they are expensive to buy and are expensive to use.

An alternative to the vacuum systems is mechanical labor wherein an employee of the paper cup manufacturer periodically sweeps up the paper waste as it is produced by the paper cup making machine. This is time consuming, and if the waste paper is not removed frequently enough, operation of the paper cup making machine may have to be temporarily stopped to make room for new waste paper.

SUMMARY OF THE INVENTION

It is an object of the invention to provide a reliable method of handling waste paper from a paper cup making machine.

It is another object to provide a machine for handling such waste paper.

These and other objects are accomplished by providing a paper winder for winding a length of waste paper from a paper cup making machine.

DETAILED DESCRIPTION OF THE INVENTION

Figure 1:
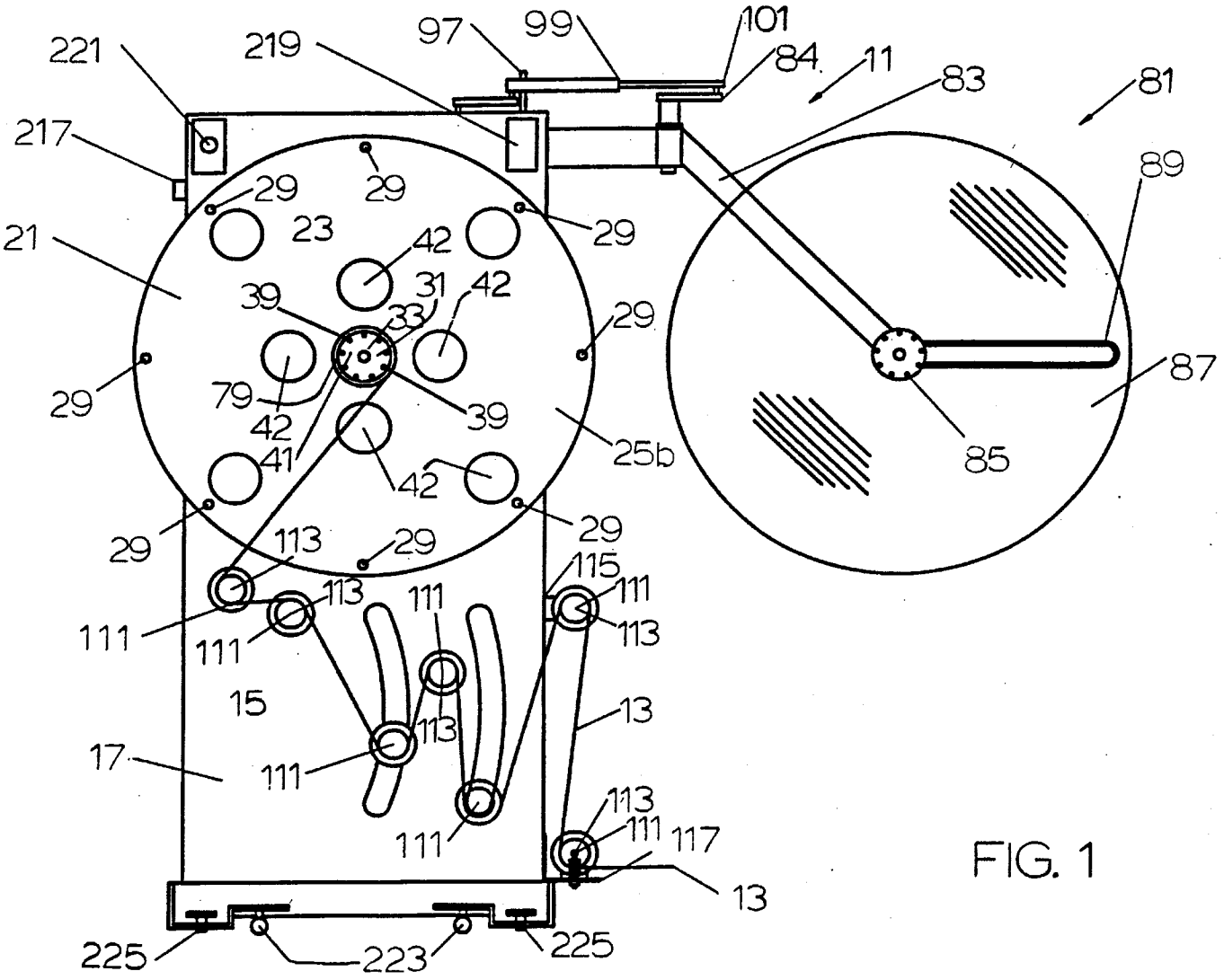
FIG. 1 iS a view in front elevation of a paper winder constructed in accordance of the invention.
Figure 2:
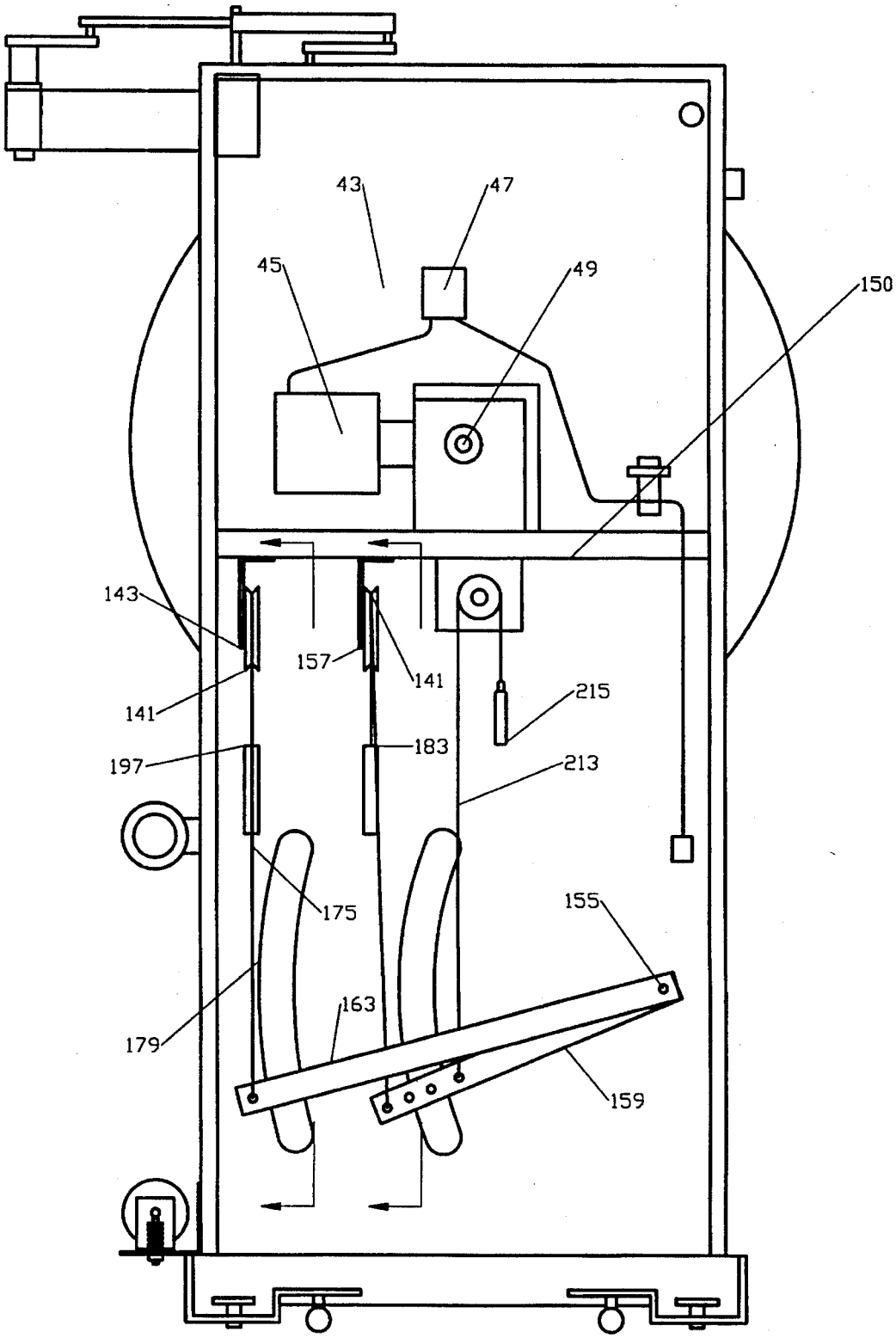
FIG. 2 is a view in rear elevation of the paper winder of FIG. 1.

Turning to the drawings, there is shown in FIGS. 1 and 2 a paper winder 11 for winding a length of waste paper 13 from a paper cup making machine for making wax-coated paper cups for soft drinks. Paper winder 11 comprises a frame 15 having a front face portion 17 and a rear face portion 19.

Figure 3:
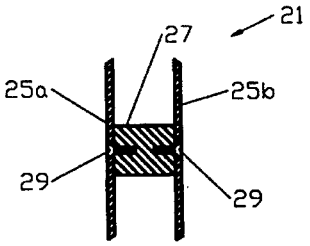
FIG. 3 is a partial view in cross section showing a spacer separating two metal sheets that form a part of a spool.

A spool 21 is rotatably mounted on the front face portion side of the frame 15. Spool 21 has a flat cylindrical disk portion 23 which, as shown in FIG. 1 and better shown in FIG. 3, is formed from two flat circular sheets **25*a*, 25*b* separated from each other by a plurality of spacers 27 and held adjacent to one another by quarter flat head screws 29 that extend through circular sheets 25*a* and 25*b* into spacers 27**.

Spool 21 has a central opening 31 extending through its disk portion 23, and a hollow cylindrical hub 33 is positioned inside opening 31 and is held in place by welding it to sheet **25*a*. Hub 33 extends from sheet 25*a* through sheet 25*b* in a close clearance fit outwardly from opening 31 away from the disk portion 23. Hub 33 is provided with two longitudinal grooves or keyways 35 each having a key 37** plug welded into.

In order to accommodate different widths of waste paper, sheet **25*b* may be positioned at any desired point along hub 33 by releasing sheet 25*b* from sheet 25*a* by unscrewing screws 29 so that the original spacers 27 may be replaced with appropriately sized spacers to position sheet 25*b* at the desired location on hub 33 separated from sheet 25*a* by the width of the substitute spacers. Flat head screws 29 are then used to secure sheets 25*a* and 25*b*** to the substitute spacers.

Ten posts 39 are mounted on the disk portion 23 and surround hub 33. Each post 39 has a threaded end portion that is smaller in diameter than the rest of the post 39 and sized to fit through a hole in circular sheet **25*b*. Nuts are screwed onto the portions of the threaded end portions of posts 39, that extend from the holes in sheet 25*a* to secure the posts 39 to sheet 25*a*. Posts 39 extend through a clearance hole 41 formed in circular sheet 25*b* and away from the disk portion 23. Each clearance hole 41 is larger than the diameter of the post 39** extending through it to allow for some play.

Sheets 25*a* and 25*b* are provided with matching holes 42 which aid in grasping spool 21 and which show that spool 21 is turning when paper winder 11 is in operation.

Figure 5:
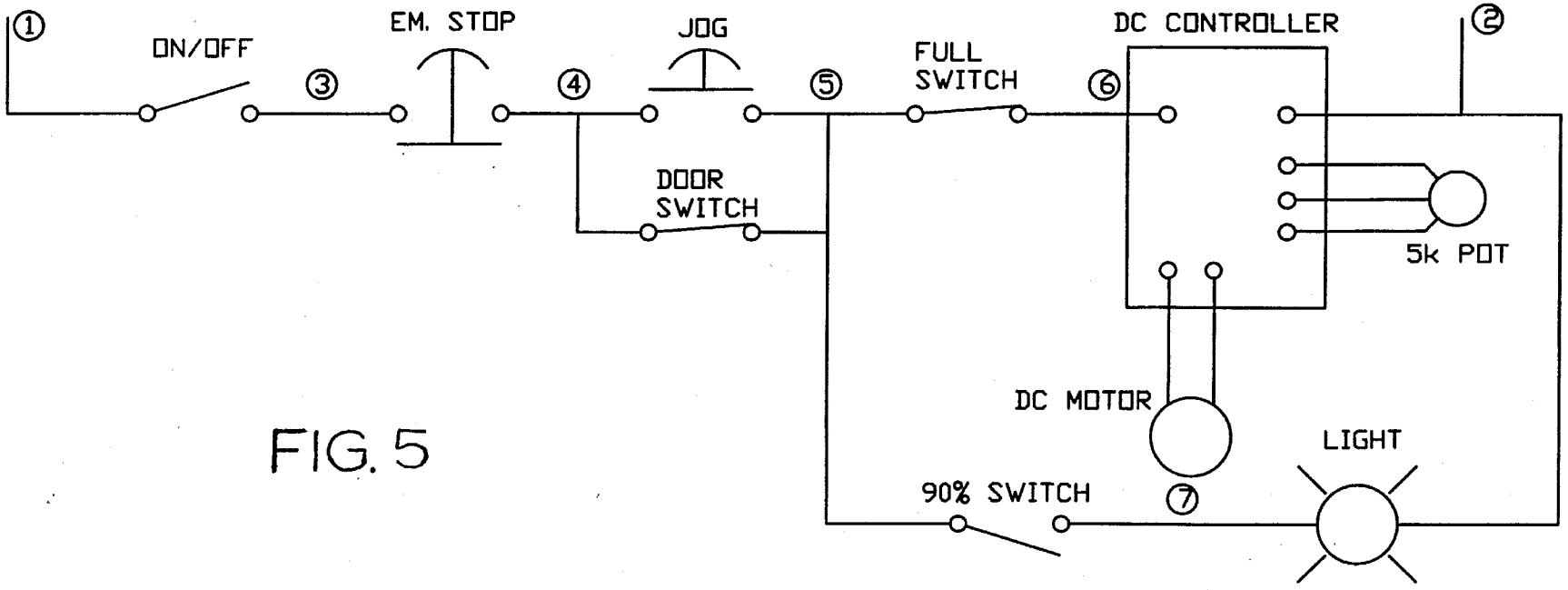
FIG. 5 shows the wiring diagram for the inventive paper winder.

Motor means 43 are mounted on the rear face portion 19 of frame 15 and comprises a DC motor 45 (such as Lesson Electric Corporation's DC permanent magnet motor model No. C4D17NK2D, RPM 1750, Volts 90, 3.5 amps), a multi-drive DC motor speed controller 47 (such as one made by Penta KB Power), and a 90° gear reduction box 49 (such as Winsmith Wingear Model No. I75MWTS41000E1). The wiring diagram for the invention is shown in FIG. 5.

Figure 4:
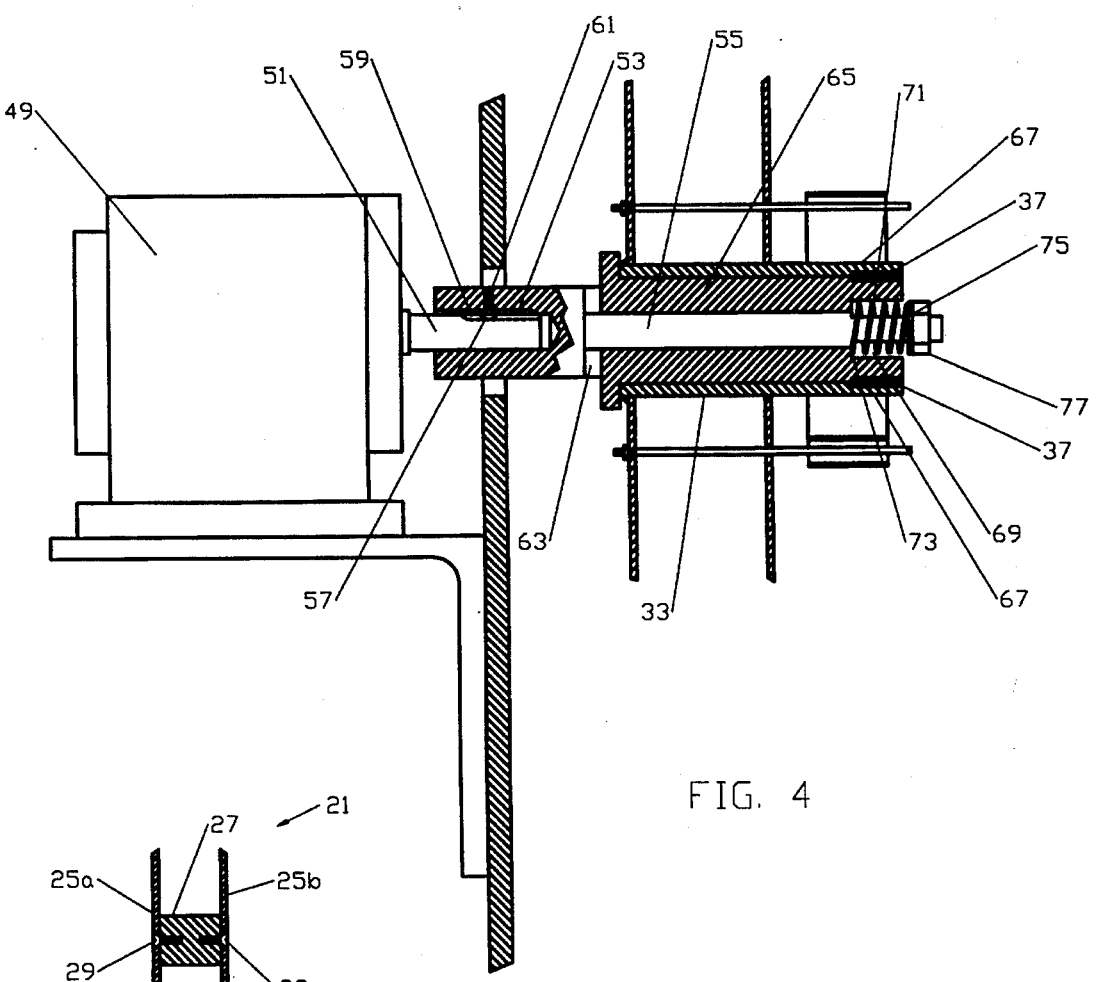
FIG. 4 is a view in cross section showing the connection of the spool to the motor means.

FIG. 4 illustrates the connection of spool 21 to motor means 43. As shown in FIG. 4, a gear box output shaft 51 extends from gear box 49 and is provided with a keyway 53. A clutch shaft 55 is mounted on the end of gear box output shaft 51 using a key 57 which fits in key way 53 of output shaft 51 and keyway 59 formed in clutch shaft 55. A set screw 61 locks everything in place.

An annular plastic clutch disc 63 is placed around clutch shaft 55 followed by a spool carrier collar 65. Spool carrier collar 65 is provided with two keyways 67 which receive keys 37 of hub 33. Clutch shaft 55 is threaded at its far end, and spool carrier collar 65 is provided with an expanded annular recess 69 at its far end. A spring 71 is positioned inside recess 69 around clutch shaft 55 and presses against a shoulder 73 formed in spool carrier collar 65 at recess 69. A washer 75 and nut 77 are secured onto the threaded end portion of clutch shaft 55 to secure spring 71 in recess 69.

Spool 21 is slid onto spool carrier collar 65. The keys 37 are set back a distance from the end of hub 33 closest to sheet 25*a* to permit the hub 33 to be placed partially on spool carrier collar 65 before keys 37 must be aligned with keyways 67 of spool carrier collar 65.

Figure 6:
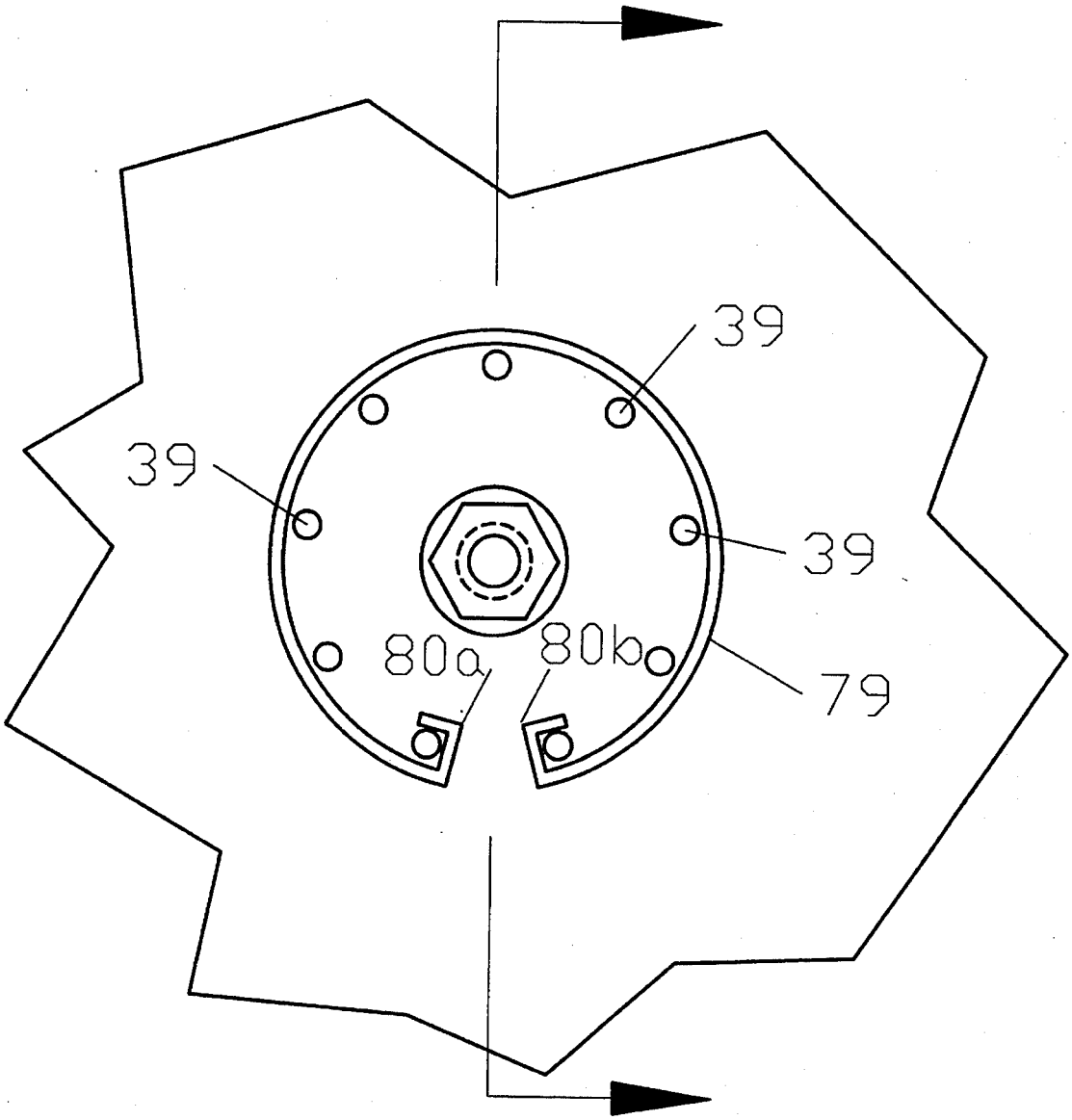
FIG. 6 shows a view in front elevation of a spring collar mounted on posts of the spool.

A resilient substantially cylindrical metal spring collar 79, as shown in FIG. 6, is provided to secure the end of the strip of waste paper 13 to the spool. Collar 79 slides over posts 39. Spring collar 79 has a first end portion 80*a* that turns inwardly to wrap around one of the posts 39 and a second end portion 80*b* that turns inwardly to wrap around one of the other posts 39 to secure collar 79 to spool 21.

The leading end portion of the strip of waste paper 13 is wrapped around collar 79 and tucked into the opening in collar 79 between end portions 80*a* and 80*b*. Collar 79 is sized such that it is somewhat larger than the circumference of the circle created by posts 39. It is desirable to have some clearance between the collar 79 and the posts 39 so that there is some play during winding. Also, end portions 80*a* and 80*b* may be pinched inwardly to pull these end portions away from the posts 39 that they are in contact with to aid in removing the roll of paper from spool 21. That is, when the roll of paper is to be removed from spool 21, the roll of paper may be grasped in one hand and the end portions 80*a* and 80*b* may be grasped in the other hand as the roll of paper (with collar 79) is pulled off of spool 21.

Cover means 81 includes a swivel arm 83 that is mounted on frame 15 by hinge 84. A bearing assembly 85 connects the end of swivel arm 83 to a free-wheeling rotating plastic cover 87. Cover 87 is bolted to bearing assembly 85. A handle 89 is mounted on the end of swivel arm 83 to facilitate moving cover 87 against spool 21 in a closed position or away from spool 21 to an open position, as desired.

Cover 87 is preferably made of a clear plastic so that the amount of paper wound onto spool 21 may be seen.

Figures 7, 18:
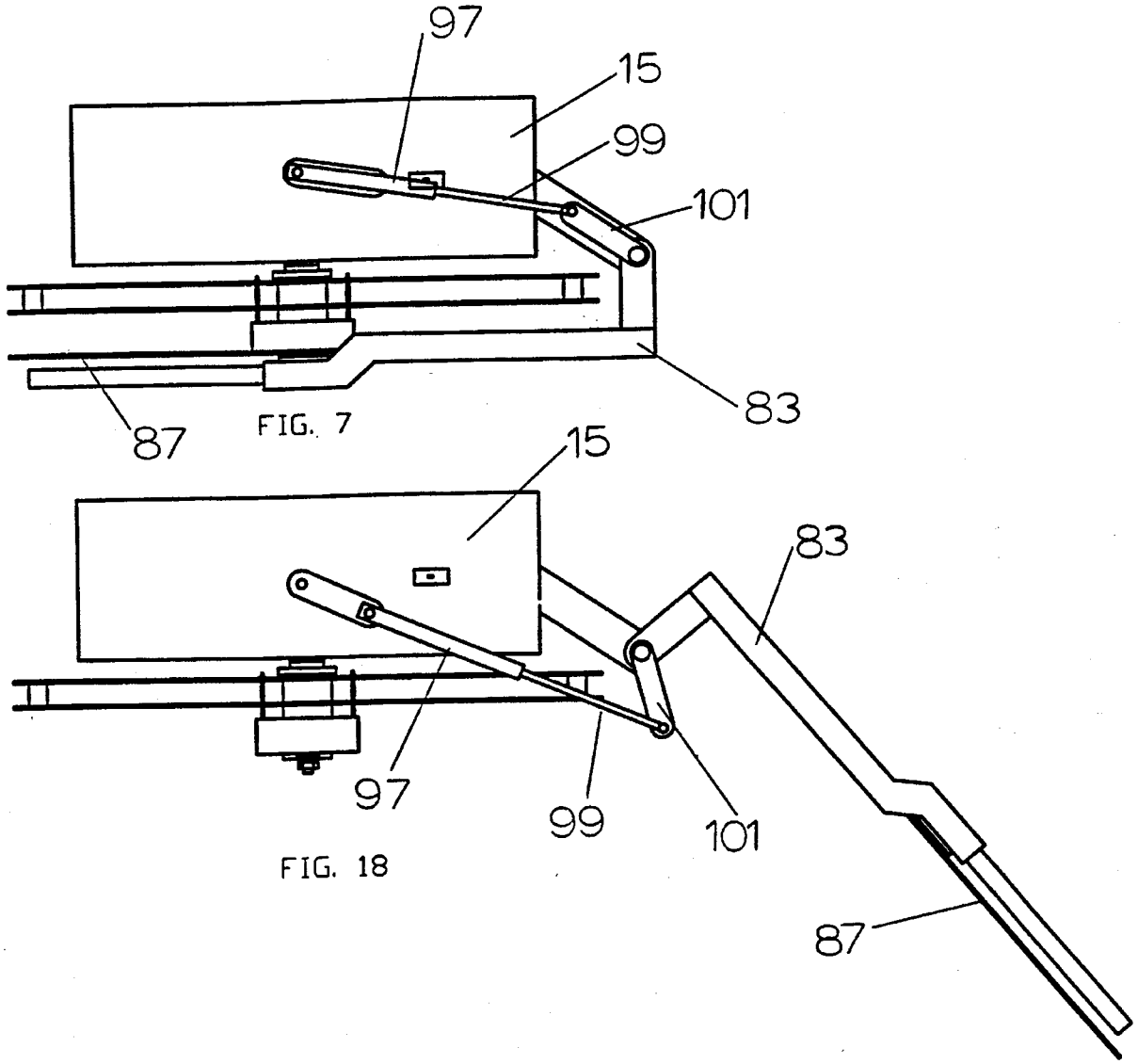
FIG. 7 is a view in top plan showing the cover of the invention in a closed position.
FIG. 18 is a top plan view showing the cover of the invention in an open position.

A gas shock 97 is pivotally mounted on frame 15 and has its piston rod 99 connected to a metal flange 101 extending from swivel arm 83. Due to gas shock 97 being pivotally mounted on frame 15 and to the positioning of gas shock 97 with respect to swivel arm 83, gas shock 97 biases the cover 87 to remain in a closed position, i.e., covering spool 21, when cover 87 is in a closed position, as shown in FIG. 7, and gas shock 97 biases cover 87 to remain in an open position when cover 87 is in open position, as shown in FIG. 18. As cover 87 is moved to an open position from a closed position, flange 101 rotates counterclockwise when looking at paper winder 11 from a top plan view pushing piston rod 99 of gas shock 97 inwardly and gas shock 97 gradually rotates clockwise when looking at the paper winder 11 from a top plan view. At about halfway between the closed position and the open position of the cover 87, flange 101 is on the same line as piston rod 99. Continuing to open the cover 87 beyond this point results in flange 101 continuing to rotate counterclockwise out of alignment with piston rod 99 and piston rod 99 is pushed outwardly from gas shock 97 to bias cover 87 in an open position. Likewise, as cover 87 is moved to a closed position from an opened position, flange 101 rotates clockwise when looking at paper winder 11 from a top plan view pushing piston rod 99 of gas shock 97 inwardly and gas shock 97 gradually rotates counterclockwise when looking at the paper winder 11 from a top plan view. At about half way between the opened position and the closed position of cover 87, flange 101 is on the same line as piston rod 99. Continuing to close the cover 87 beyond this point results in flange 101 rotating clockwise out of alignment with piston rod 99 and piston rod 101 is pushed outwardly from gas shock 97 to bias cover 87 in a closed position.

Figure 8:
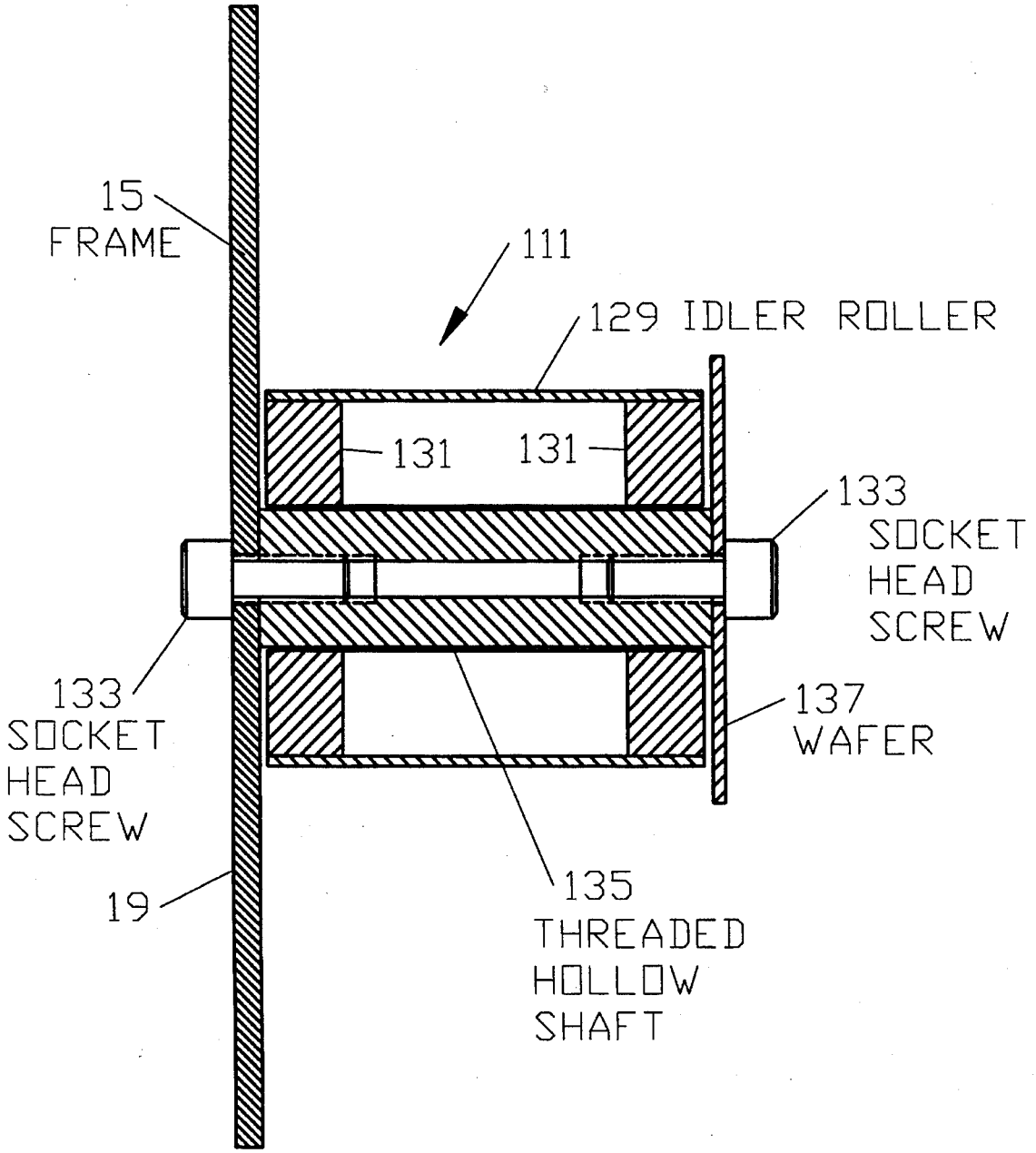
FIG. 8 is a view in cross section showing a roller mounted on the frame of the paper winder.

Referring to FIGS. 1 and 8, three free-wheeling idler rollers 111 are mounted on shafts 113 extending from the front face portion 17 of frame 15. A fourth free-wheeling idler roller 111 is mounted on shaft 113 that is mounted on a bracket 115 that is mounted to the side portion of frame 15.

Figure 9:
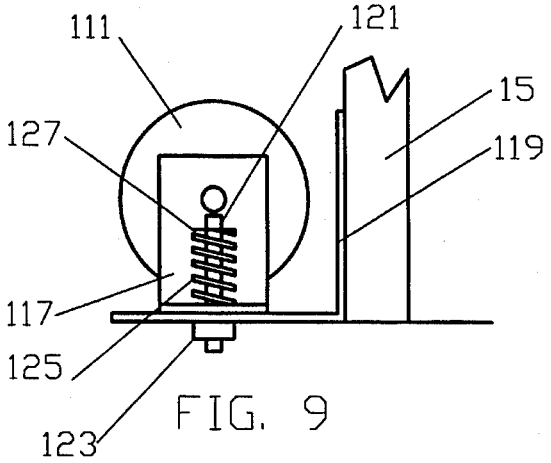
FIG. 9 is a partial view in rear elevation showing a roller mounted on a rotatable bracket.

A fifth free-wheeling idler roller 111 is mounted on a shaft 113 that is mounted on a bracket 117 at the lower side portion of frame 15. As shown in FIG. 9, bracket 117 is mounted on bracket 119 that is attached to frame 15. Bracket 117 is mounted on bracket 119 by a threaded bolt 121 and nut 123. A spring 125 and washer 127 are placed on the threaded bolt 121 before the bolt 121 is inserted in through aligned holes in the brackets 117 and 119 and secured tightly in place by nut 123. Due to this construction, bracket 117 swivels on bracket 119.

Each roller 111 has the same construction and is either mounted on frame 15, on bracket 115, or bracket 117. FIG. 8 illustrates a roller 111 mounted directly on frame 15 through a hole in frame 15. The rollers 111 mounted to brackets 115 and 117 are of the same construction and they are mounted through holes in the brackets 115 and 117 rather than through a hole in frame 15. As shown in FIG. 8, roller 111 comprises a stainless steel cylindrical tube 129 having annular bushings 131 press fit into each end portion of tube 129. The threaded portion of a socketed head screw 133 is inserted from the rear face portion 19 of frame 15 through a hole in frame 15 into a threaded hollow shaft 135. Cylindrical tube 129, with bushings 131 mounted thereon, is placed on shaft 135, followed by a washer 137. A second socketed head screw 133 is screwed into the second end of threaded hollow shaft 135 to secure the roller 111 on shaft 135.

Figure 10:
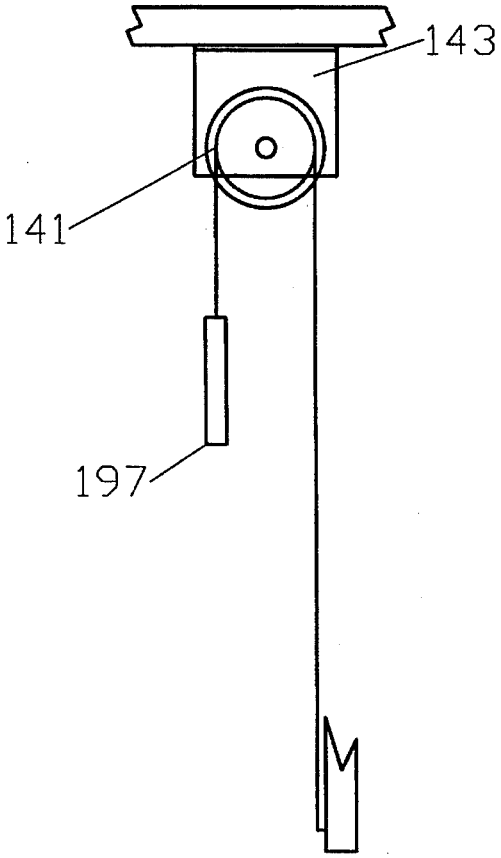
FIG. 10 is a view in side elevation showing a pulley.
Figure 11:
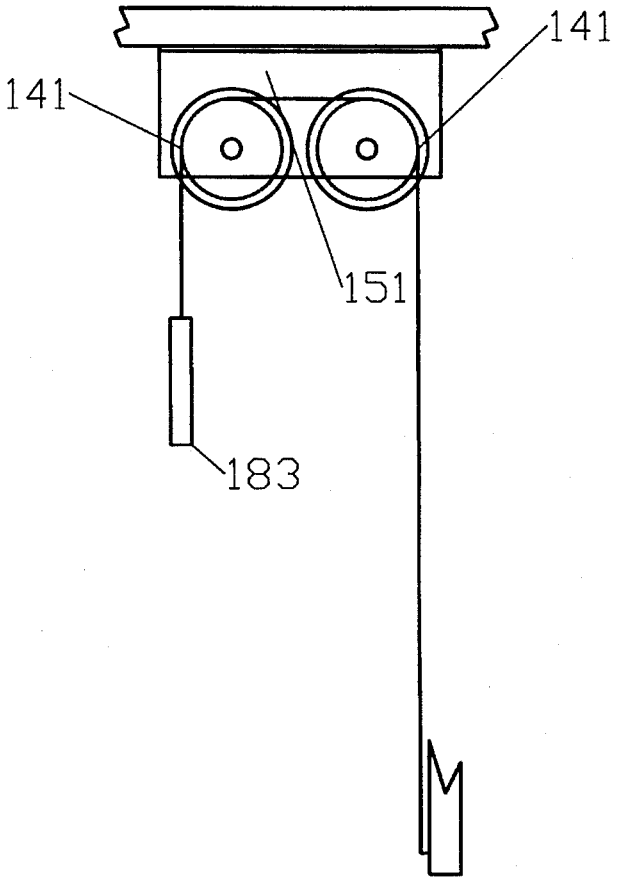
FIG. 11 is a view in side elevation showing two pulleys.
Figure 12:
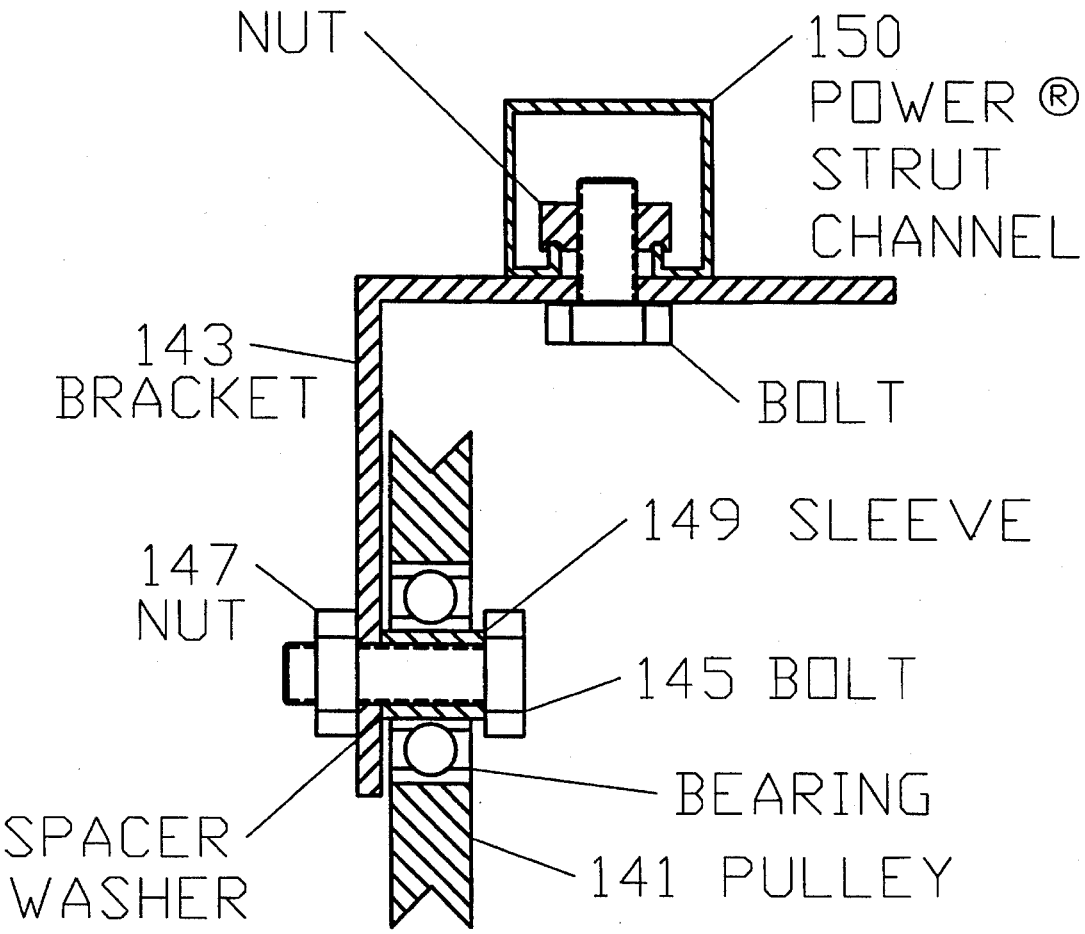
FIG. 12 is a cross sectional view of a pulley.

Turning to FIG. 2, and more particularly FIGS. 10 and 12, a first pulley 141 is mounted on an L-shaped bracket 143 using a bolt 145 that is secured to the bracket 143 by a nut 147. A sleeve 149 is placed around bolt 145 on which pulley 141 rotates. Bracket 143 is mounted on frame 15 by bolting it to a Power Strut® channel 150 that is attached to the rear face portion 19 of frame 15.

A second pulley 141 and a third pulley 141 are mounted to an L-shaped bracket 151 in the same manner that first pulley 141 is mounted to bracket 143. Likewise, bracket 151 is mounted on frame 15 by bolting it to the Power Strut® channel 150 attached to the rear face portion 19 of frame 15.

Figure 13:
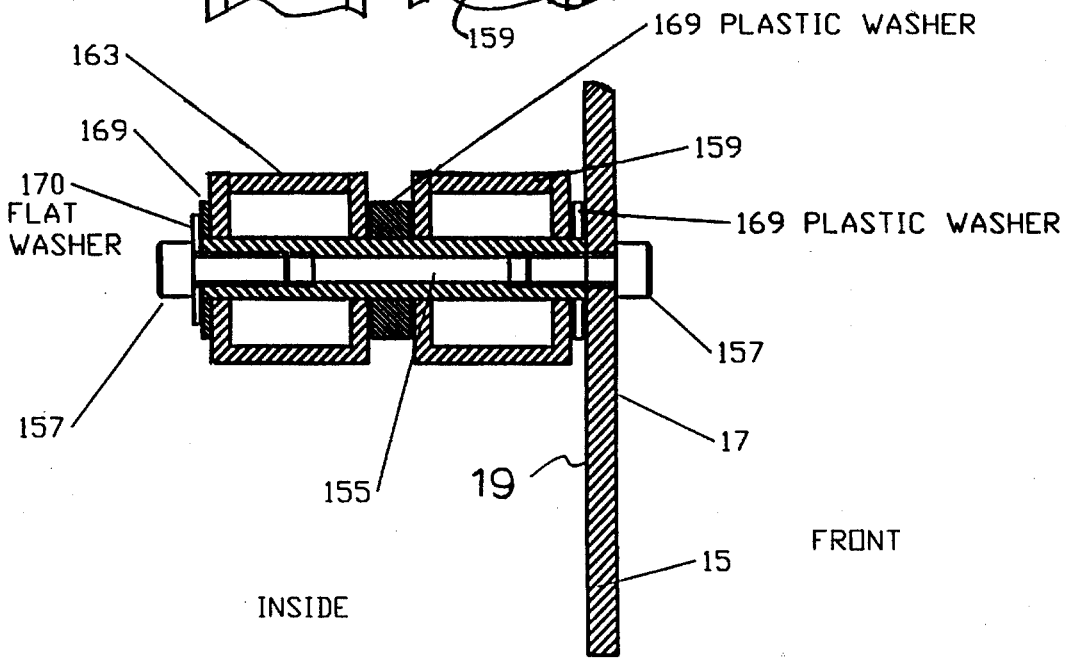
FIG. 13 is a view in cross section showing the connection of first and second arm members to the frame of the inventive paper winder.

Referring to FIGS. 2 and 13, a shaft 155 comprising a threaded circular hollow tube is mounted on the rear face portion 19 of frame 15 by inserting a socketed head screw 157 from the front face portion 17 of frame 15 through a hole in frame 15 into threaded shaft 155. A first arm member 159 made from hollow aluminum square tubing is provided with a circular hole through two of its matching faces at one of its end portions, and first arm member 159 is mounted on shaft 155 such that shaft 155 extends through these circular holes in arm member 159. A second arm member 163, also made from hollow aluminum square tubing and also having a pair of matching circular holes in one of its end portions, is also rotatably mounted on shaft 155 by having shaft 155 extend through the holes in its end portion. Plastic washers 169 are mounted on shaft 155 and are used to separate first arm member 159 from frame 15, first arm member 159 from second arm member 163, and second arm member 163 from a metal washer 170 at the end of shaft 155 which surrounds a second socketed headscrew 157 that is inserted into the second end of the threaded hollow shaft 155. Washer 170 held in place by second socketed headscrew 157 prevents the arm members 159 and 163 from sliding off shaft 155.

Figure 14:
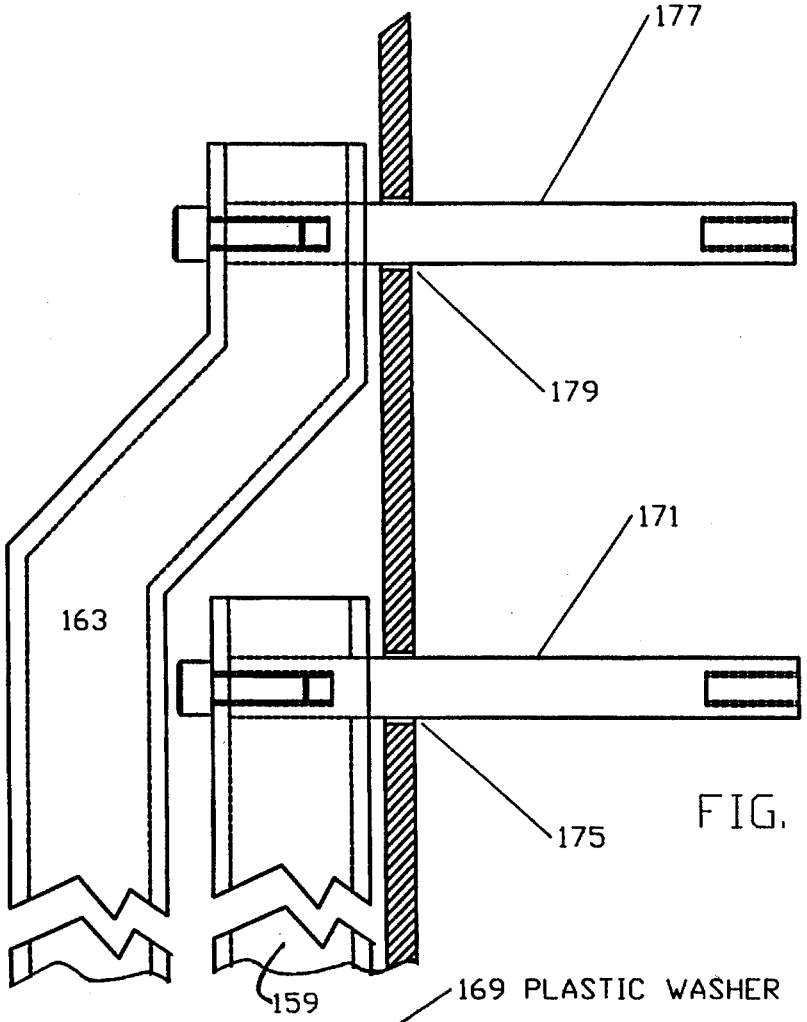
FIG. 14 is a view in partial cross section showing the second end portions of the first and second arm members of the inventive paper winder.

As shown in FIG. 14, second arm member 163 is longer than first arm member 159, and second arm member 163 is offset inwardly towards the rear face portion 19 of frame 15 at its second end portion where it extends beyond the second end portion of first arm member 159.

Figure 15:
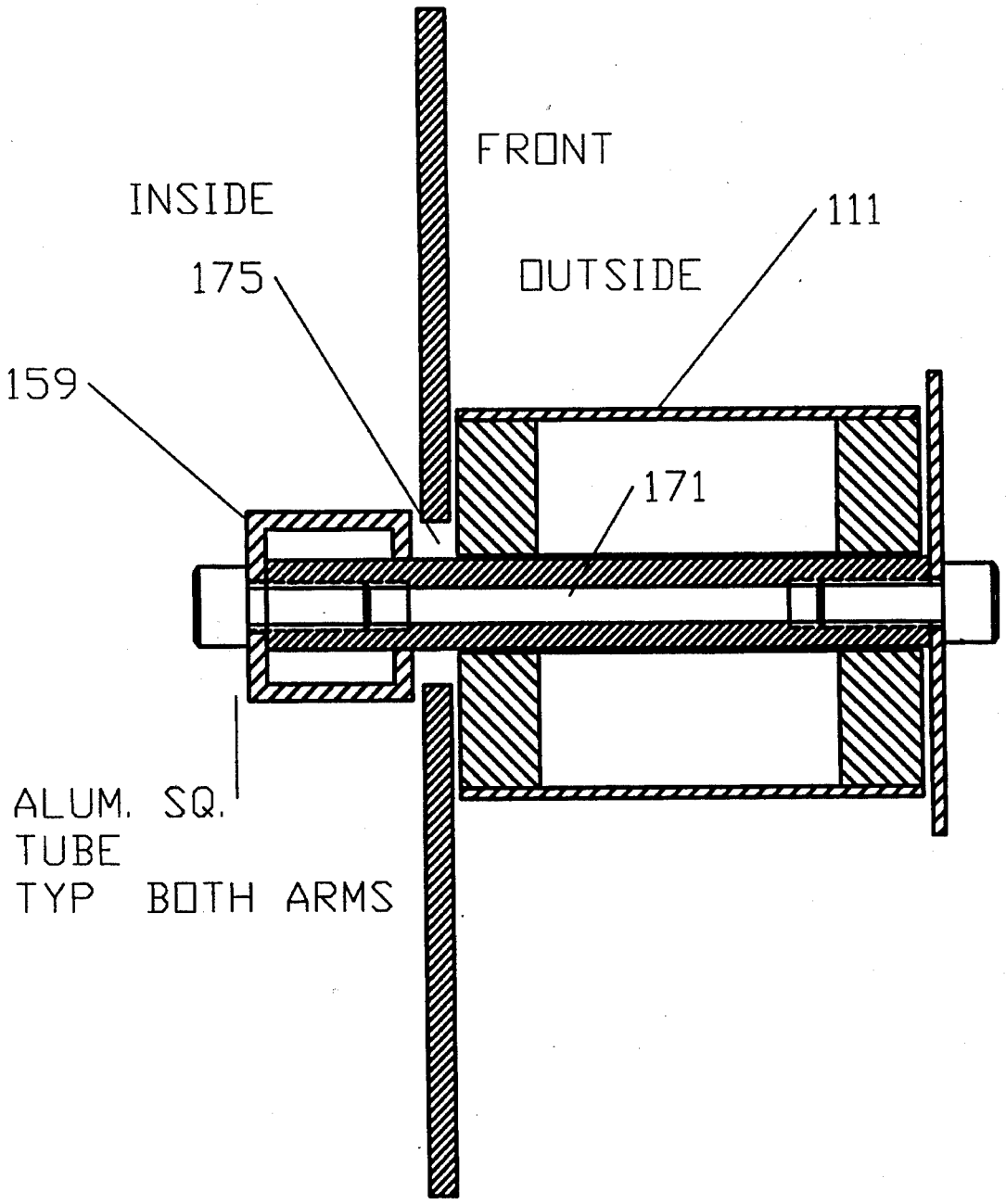
FIG. 15 is a view in cross section showing a roller mounted on an arm member.

Referring to FIG. 15, the second end portion of first arm member 159 is also provided with a pair of matching circular holes which receives a threaded hollow shaft 171. The threaded portion of a socketed head screw is inserted through the hole in the second end portion of first arm member 159 that is farther from frame 15 and into shaft 171.

Shaft 171 extends from first arm member 159 through a slot 175 in frame 15 to the front face portion side of frame 15. A sixth free-wheeling idler roller 111 is mounted on shaft 171 in the same manner that the first three rollers 111 are mounted on shaft 113.

In a manner substantially the same as the mounting of shaft 171 onto the second end portion of first arm member 159, second arm member 163 is provided with a shaft 177 which extends through a slot 179 in frame 15. Similarly, a seventh free-wheeling idler roller 111 is mounted on shaft 177 on the front face portion side of frame 15 just as the sixth roller 111 is mounted on shaft 171.

Slots 175 and 179 are shaped to permit vertical movement of the sixth roller 111 mounted on shaft 171 and the seventh roller 111 mounted on shaft 177 as first arm member 159 and second arm member 163 rotate around shaft 155.

Figure 16:
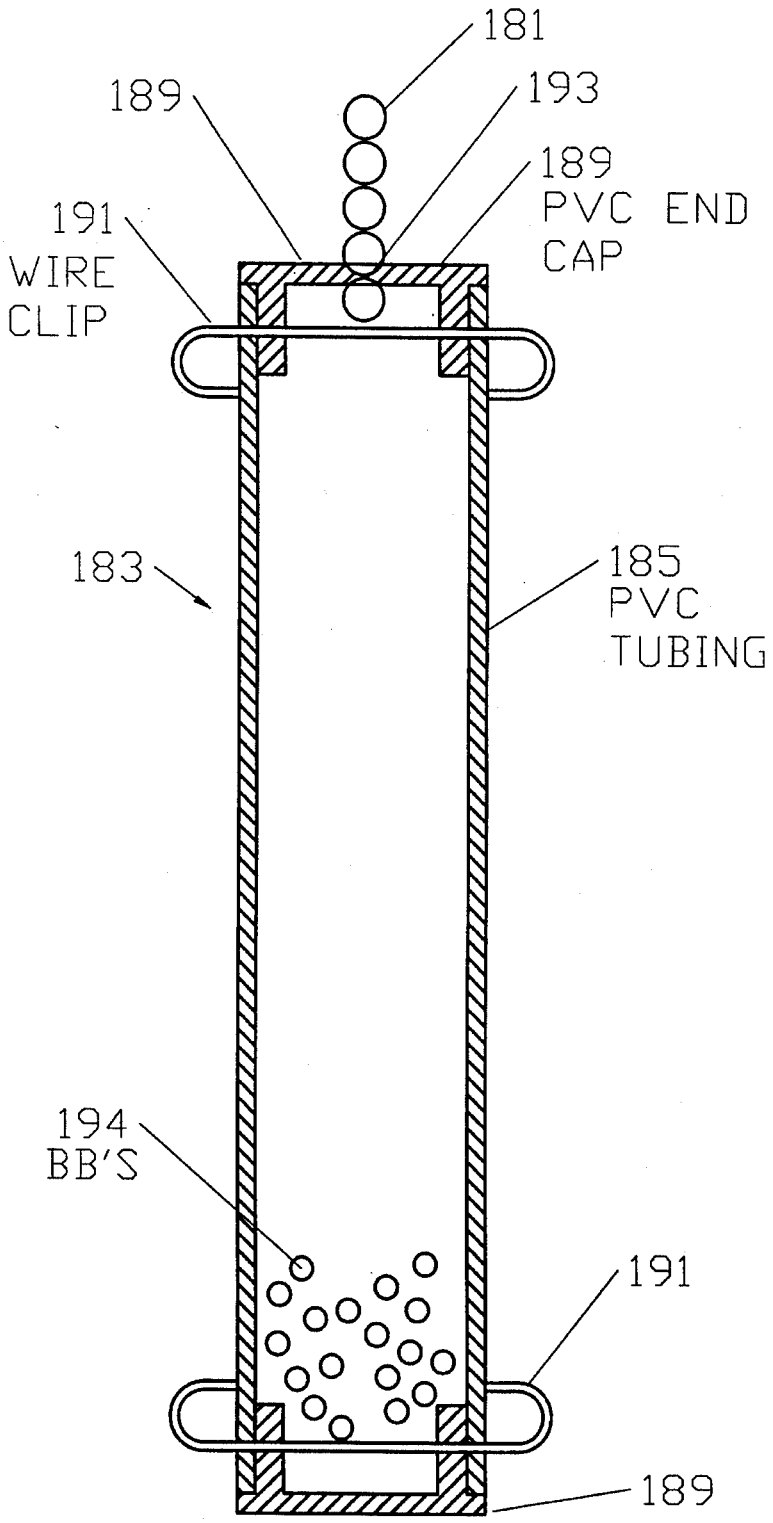
FIG. 16 is a view in cross section showing a weighting device used in the invention.

A first chain 181, preferably of the type of chain used to turn a lamp on and off with, has a first end portion that is attached to first arm member 159. Chain 181 extends over second pulley 141 and third pulley 141 mounted on bracket 151 to a free-hanging counter weighting device 183 attached at its second end portion. Referring to FIG. 16, weighting device 183 comprises hollow PVC tubing 185 having a PVC end cap 189 inserted at each end and attached to the PVC tubing 185 by wire clips 191. The PVC end cap 189 that forms the top of weighting device 183 is provided with a hole 193 to receive and hold the second end portion of first chain 181. Weighting device contains BB's 194, and the weight of the weighting device 183 may be varied as desired by adding or subtracting BB's 194 from weighting device 183.

A second chain 195, also preferably of the type used with lamps, is attached at its first end portion to second arm member 163. Second chain 195 extends over first pulley 141 which is mounted on bracket 143 to a second free-hanging counter weighting device 197 which is attached to the second end portion of second chain 195. Second weighting device 197 has the same construction as first weighting device 183.

Figure 17:
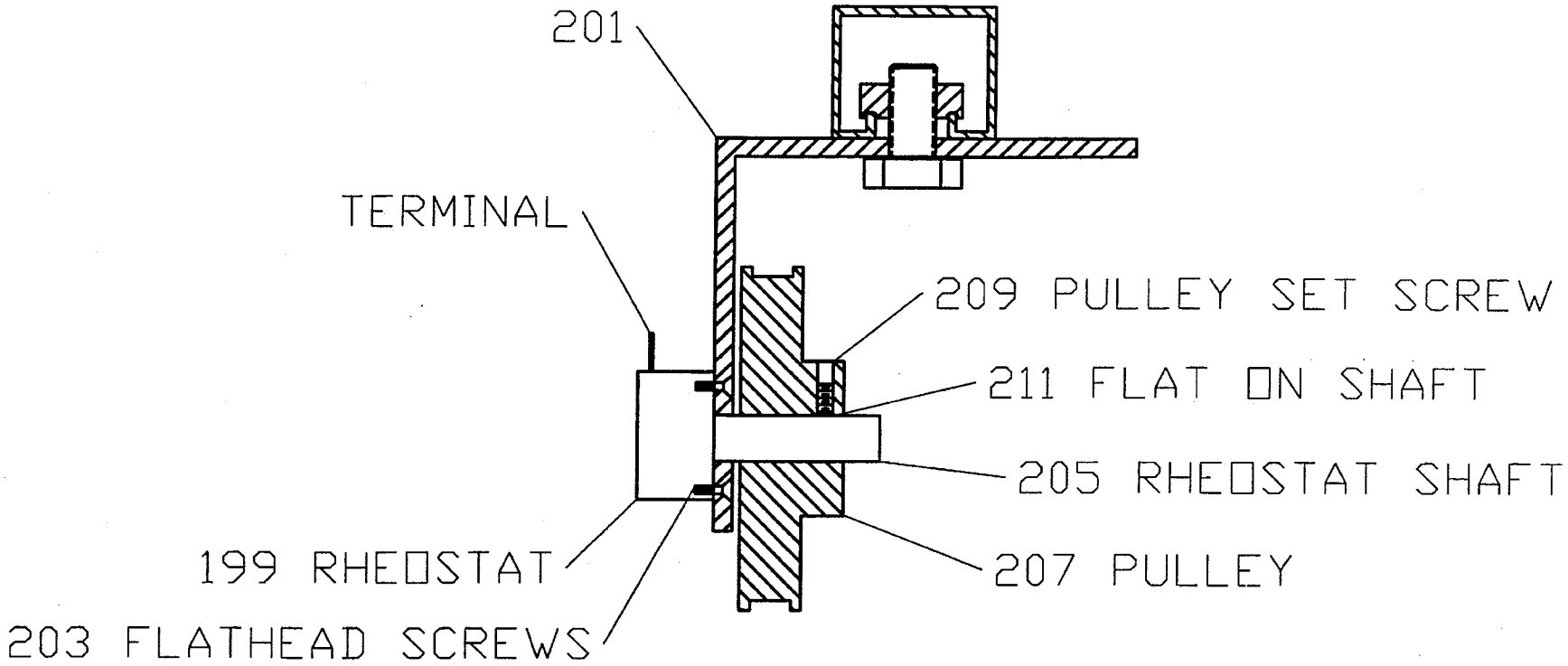
FIG. 17 is a view in partial cross section showing a pulley mounted on a rheostat shaft.

Referring to FIGS. 2 and 17, a rheostat 199 is mounted on a bracket 201 that is bolted to channel 150. Rheostat 199 is held on bracket 201 by flat head screws 203. Bracket 201 is provided with a hole through which rheostat shaft 205 passes. A pulley 207 is fixedly mounted on rheostat shaft 205 using a set screw 209 and extends through pulley 207 and up against a flat 211 formed in rheostat shaft 205.

A cord 213, preferably braided turner control cord, which is soft enough to loop but resists stretching, is attached to the first arm member 159 and extends 1 ½ times around pulley 207 to a free-hanging weight 215 that is attached to the second end portion of cord 213. Vertical movement of first arm member 159 causes cord 213 to rotate pulley 207 that is fixedly mounted on rheostat shaft 205 and this causes the output of the rheostat 199 to increase or decrease the motor speed of the motor means 43. An increase or decrease of the motor speed depends on which direction the cord 213 rotates the pulley 207.

Paper winder 11 is also provided with an on/off switch 217, an emergency off switch 219 shuts down paper winder 11 if cover 87 is opened during operation, and a jog switch 221.

The wiring details connecting together the rheostat 199, the on/off 217 switch, the emergency off switch 219, the jog switch 221, and the motor means 43 are shown in FIG. 5.

Paper Winder 11 is also provided with wheels 223 in the four corners of the bottom wall of frame 15 to facilitate moving paper winder 11 when desired.

Also, leveling screws 225 are provided in the four corners of the bottom wall frame 15 to facilitate leveling of paper winder 11 when leveling is needed.

In operation, paper winder 11 is placed in a location preferably perpendicular to the feed path of waste paper 13 from the paper cup making machine. If this is not possible, roller 111 that is mounted on bracket 117 is rotated such that roller 111 is perpendicular to the feed path of the waste paper 13 coming,from the paper cup making machine.

The cover 87 is moved to an open position, and the on/off switch 217 is switched on. The waste paper strip is fed through the feed path shown in FIG. 1, i.e., under roller 111 mounted on bracket 117, over roller 111 mounted on bracket 115, under roller 111 mounted on shaft 177, over third roller 111, under roller 111 mounted on shaft 171, over second roller 111 and under first roller 111, and around spring collar 79, with the lead portion of the waste paper strip 13 being tucked into the opening between end portions **80*a* and 80*b* of spring collar 79**.

Then, the jog switch 221 is pushed which causes the spool 21 to make a couple of revolutions thereby winding the first end portion of the waste paper 13 around spool 21. Cover 87 is then positioned in a closed position which activates motor means 43 and causes revolution of spool 21 to wind waste paper 13.

Motor means 43 runs at full speed until all the slack in waste paper strip 13 is taken up. After the slack in the waste paper strip 13 has been taken up, the tension in the waste paper strip 13 will start to lift first arm member 159 by pushing upwardly against roller 111 mounted on shaft 171. As this happens, the speed of motor means 43 is decreased to match the flow of paper being fed to paper winder 11 because as first arm member 159 moves upwardly toward the top of slot 175 causing cord 213 attached to first arm member 159 to turn pulley 207 attached to rheostat shaft 205 to change the output from the rheostat to decrease the motor speed of motor means 43. The lower first arm member 159 is in slot 175, the faster the motor speed of motor means 43. The higher the first arm member 159 is in slot 175, the slower the motor speed is of motor means 43.

If the flow of waste paper 13 from the cup making machine stops, first arm member 159 and second arm member 163 both move upwardly toward the top of slots 175 and 179, and when first arm member 159 reaches the top of slot 175, cord 213 turns pulley 207 on rheostat shaft 205 causing the rheostat 199 to decrease the motor speed of motor means 43 to zero.

Second arm member 163, with its roller 111 attached thereto, provides time for the motor means 43 to react to the rheostat setting so that the strip of waste paper 13 is not torn when wind speeds change. For example, when winding moves from a high speed to a dead stop, the paper does not rip because the slack (about 3 feet of paper) in the paper created by roller 111 attached to second arm member 163 moving to the top of second slot 179 is greater than or equal to the amount of paper being wound onto spool 21 as it continues to turn about an additional 90° after the motor speed of motor means 43 is zero.

As paper begins to be fed again from the paper cup making machine, first arm member 159 and second arm member 163 both start to drift downwardly by gravity. Such movement causes the setting of the rheostat to change (cord 113 turning pulley 207 mounted on rheostat shaft 205) thereby activating motor means 43 to start at a slow speed. Waste paper 13 starts to wind on spool 21 until the speed of winding equals the speed of the waste paper feed from the paper cup making machine.

The first and second counter balance weighting devices 183 and 197 are heavy enough so that the paper on spool 21 is wound tightly, but not so heavy as to cause too much tension on the paper to cause the paper to tear during operation. In practice, for the weight of paper waste 13 tested, the weighting device 183 is somewhat heavier than weighting device 197.

Winding from the bottom as is done in the inventive paper winder 11 provides tighter winding than winding from the top.

The paper winder 11 of the invention winds about a 40 inch diameter spool of paper.

I claim:

1. A paper winder for winding a length of waste paper from a paper cup making machine for making cups for soft drinks, comprising a frame having a front face portion and a rear face portion, a spool rotatably mounted on the front face portion of the frame, motor means connected to the spool for rotating the spool, rotatable cover means mounted on the frame for holding the waste paper against the spool during winding of the waste paper, a plurality of free-wheeling idler rollers mounted on shafts extending from the front face portion of the frame, a first pulley mounted on the rear face portion of the frame, a second pulley mounted on the rear face portion of the frame, a first shaft mounted on the frame and extending from the rear face portion of the frame, a first arm member having a first end portion and a second end portion, the first arm member being rotatably mounted on the first shaft at the first end portion of the first arm member, a second arm member having a first end portion and a second end portion, the second arm member being rotatably mounted on the first shaft at the first end portion of the second arm member, the second end portion of the second arm member being farther away from the first shaft then the second end portion of the first arm member is from the first shaft, a first slot formed in the frame, a second slot formed in the frame, a second shaft mounted on the first arm member and extending through the first slot, the first slot being shaped to permit some vertical movement of the first arm member, a free-wheeling idler roller rotatably mounted on the second shaft on the front face portion side of the frame, a third shaft mounted on the second arm member and extending through the second slot, the second slot being shaped to permit some vertical movement of the second arm member, a free-wheeling idler roller rotatably mounted on the third shaft on the front face portion side of the frame, a first chain having a first end portion and a second end portion, the first end portion of the first chain being attached to the first arm member, the first chain extending over the first pulley and being connected at its second end portion to a first weight, a second chain having a first end portion and a second end portion, the first end portion of the second chain being attached to the second arm member, the second chain extending over the second pulley and being connected at its second end portion to a second weight, a rheostat mounted on the rear face portion of the frame, the rheostat having a rheostat shaft having a pulley fixedly mounted thereon, the rheostat being connected to the motor means to control the motor speed and therefore the speed of rotation of the spool, a cord having a first end portion and a second end portion, the first end portion of the cord being attached to the first arm member, the cord extending around the pulley mounted on the rheostat shaft, and a third weight attached to the second end of the cord, wherein vertical movement of the first arm member causes the cord to rotate the pulley fixedly mounted on the rheostat shaft which changes the output of the rheostat to increase or decrease the motor speed of the motor means depending on which direction the cord is rotating the pulley mounted on the rheostat shaft.

2. The paper winder of claim 1, the spool having a flat circular disk portion, a central opening extending through the disk portion, a hollow cylindrical hub aligned with the central opening and extending away from the disk portion, and a plurality of posts mounted on the disk portion surrounding the hub, further including a resilient substantially cylindrical spring collar that slides over the posts, said spring collar having a first end portion that turns inwardly to wrap around one of the posts, and said spring collar having a second end portion that turns inwardly to wrap around one of the other posts.

* * * * *